US005605214A

United States Patent [19]

Yukimoto et al.

[11] Patent Number: 5,605,214

[45] Date of Patent: Feb. 25, 1997

[54] BANKNOTE PROCESSOR

[75] Inventors: Koji Yukimoto, Sakado; Kenji Nishiumi, Hanno; Kanesue Shimizu, Sakado, all of Japan

[73] Assignee: Kabushiki Kaisha Nippon Conlux, Japan

[21] Appl. No.: 522,912

[22] Filed: Sep. 1, 1995

Related U.S. Application Data

[63] Continuation of Ser. No. 91,961, Jul. 15, 1993, abandoned.

[30] Foreign Application Priority Data

Jul. 29, 1992 [JP] Japan ..... 4-202649
Dec. 3, 1992 [JP] Japan ..... 4-324461

[51] Int. Cl.[6] ..... G07F 7/04

[52] U.S. Cl. ..... 194/348

[58] Field of Search ..... 194/200, 201, 194/202, 206, 207, 348

[56] References Cited

U.S. PATENT DOCUMENTS

| | | | |
|---|---|---|---|
| 4,062,149 | 12/1977 | Chalabian . | |
| 4,165,802 | 8/1979 | Mathews . | |
| 4,306,644 | 12/1981 | Rockola et al. . | |
| 4,346,798 | 8/1982 | Agey, III . | |
| 4,513,439 | 4/1985 | Gorgone et al. . | |
| 4,678,072 | 7/1987 | Kobayashi et al. | 194/206 |
| 4,809,966 | 3/1989 | Kobayashi et al. | 194/206 X |
| 5,156,250 | 10/1992 | Parish et al. | 194/348 |
| 5,195,739 | 3/1993 | Watabe | 194/206 X |
| 5,236,339 | 8/1993 | Nishiumi et al. | 194/348 X |
| 5,318,164 | 6/1994 | Barnes et al. | 194/348 X |

FOREIGN PATENT DOCUMENTS

| | | | |
|---|---|---|---|
| 2139149 | 4/1993 | Germany . | |
| 1306982 | 12/1989 | Japan | 194/348 |
| 2118795 | 5/1990 | Japan | 194/348 |
| 2178897 | 7/1990 | Japan | 194/348 |
| 2-178897 | 7/1990 | Japan | 194/348 |

*Primary Examiner*—F. J. Bartuska
*Attorney, Agent, or Firm*—Welsh & Katz, Ltd.

[57] ABSTRACT

A banknote processor for judging whether a banknote inserted into a banknote insertion port is authentic or false, storing the inserted banknote in the interior of a processor body when judging that the banknote is authentic and returning the inserted banknote to the banknote insertion port when judging that the banknote is false. In the banknote processor, a fluid collector for collecting fluid dropping from a bottom of the processor body is disposed at a lower side of the bottom of the processor body, and a fluid guiding member is communicatingly connected to the fluid collector for guiding the collected fluid externally of the processor body.

6 Claims, 7 Drawing Sheets

BANKNOTE PROCESSOR

This application is a continuation of Ser. No. 08/091,961, filed Jul. 15, 1993, now abandoned.

BACKGROUND OF THE INVENTION

1. Field of the Invention

The present invention relates to a banknote or paper money processor which is installed in the interior of such a service machine as an automatic vending machine or a money exchanging machine to discriminate between authentic and false banknotes inserted into the processor and to sequentially accumulate the banknotes judged as authentic ones.

2. Description of the Related Art

Some of such service machines including automatic vending machines and money exchanging machines are installed with such a banknote processor which can discriminate between authentic and false banknotes inserted into the processor and can sequentially accumulate the banknotes regarded as authentic ones.

FIG. 9 shows, in conceptional cross-sectional view, such a conventional banknote or paper money processor 1 as mentioned above, depicting a state after the processor is mounted in an automatic vending machine.

The banknote processor 1 includes a processor body 2 which is formed into a generally L shape as viewed from side. Provided at a lower left tip end of the processor body 2 is a banknote insertion port 3 which in turn is directly mounted to a door 8 constituting a front face of such a machine as an automatic vending machine so that part of a tip end of the banknote insertion port 3 is externally exposed.

With such a banknote processor 1, when a banknote (not shown) is inserted into the banknote insertion port 3, a sensor for detection of the banknote disposed within the banknote insertion port 3 detects the insertion of the banknote and generates a detection signal. The detection of the inserted banknote causes a first conveying belt 4 for conveying the banknote in a horizontal direction to rotate forwardly (clockwise) on the basis of the detection signal, while the detection causes a second conveying belt 5 to rotate reversely (counterclockwise), whereby the inserted banknote is conveyed to the processor body 2. More specifically, in the banknote processor 1, a driving motor (not shown) is disposed at the side of the second conveying belt 5 so that the first conveying belt 4 is driven as followed by the second conveying belt 5 through such power transmission means as gears.

In this way, when the forward driving of the first conveying belt 4 causes the inserted banknote to be horizontally conveyed in the right direction of the drawing, a sensor for detection between authentic and false banknotes disposed nearly at an intermediate position of the first conveying belt 4 judges whether the inserted banknote is authentic or false.

When the banknote authentic/false detection sensor judges that the inserted banknote is false, the first conveying belt 4 is reversely (counterclockwise) rotated so that the inserted banknote is returned to the banknote insertion port 3.

When the banknote authentic/false detection sensor judges that the inserted banknote is authentic, on the other hand, the detection signal of the sensor causes the first conveying belt 4 to forwardly rotate while causes the second conveying belt 5 to reversely rotate continuously, whereby the banknote judged as authentic one is conveyed upwardly of the processor body 2 by the second conveying belt 5 and thereafter sequentially stacked and accumulated in a stocker 6.

Incidentally, in such a conventional banknote processor 1 as mentioned above, when such water as rain water or such viscous fluid as detergent is made to flow into the banknote insertion port 3 as shown by an arrow A, the fluid flows into the vicinity of a bottom plate 7 which forms a bottom of the processor body 2 as shown by arrows, further leaks from the lower part of the processor body 2 into the interior of such a machine as an automatic vending machine having the banknote processor 1 installed thereto.

And once such viscous fluid as detergent flows into the interior of such an automatic vending machine, the fluid adheres to various parts disposed within the machine such as driving parts, printed circuit boards or electronic devices, which disadvantageously results not only in that the parts attached with the fluid becomes faulty and the function of the machine having the banknote processor 1 installed thereto is deteriorated but also in that the operation of the machine is locked and thus the function of the machine itself having the banknote processor 1 installed thereto is stopped.

Meanwhile, in order to solve the above problem, there has been suggested a banknote processor in which a bottom member of a banknote insertion port is formed to be curved and the curved bottom member is provided therein with a fluid discharging means comprising a plurality of slit openings, so that fluid introduced into the banknote insertion port is discharged from the bottom of the insertion port through the fluid discharging means, thereby preventing invasion of the fluid into the interior of a machine having the banknote processor installed thereto, as disclosed in U.S. Pat. No. 5,156,250. This prior art, however, has a difficulty that, since the fluid discharging means is provided only to the banknote insertion port, once fluid invades into the interior of the banknote processor, it is impossible to discharge the fluid out of the machine.

The prior art (U.S. Pat. No. 5,156,250) also has another difficulty that since the bottom of the banknote insertion port is curved, it is difficult for users to insert banknote into the banknote insertion port.

SUMMARY OF THE INVENTION

It is an object of the present invention to provide a banknote processor which can prevent invasion of fluid from the bottom of a processor body into the interior of a machine having the banknote processor installed thereto.

In accordance with an aspect of the present invention, the above object is attained by providing a banknote processor for judging whether a banknote inserted into a banknote insertion port is authentic or false, storing the inserted banknote in the interior of a processor body when judging that the banknote is authentic and returning the inserted banknote to the banknote insertion port when judging that the banknote is false, which banknote processor comprises a fluid collector disposed at a lower side of a bottom of the processor body for collecting fluid dropping from the bottom, and a fluid guiding member communicatingly connected to the fluid collector for guiding the collected fluid to outside of the processor body.

With such a banknote processor, such fluid as detergent flowing from the banknote insertion port into the bottom of the processor body is collected into the fluid collector disposed at the lower side of the bottom of the processor body, and thereafter the fluid collected in the fluid collector is quickly discharged externally of a machine in which the banknote processor is mounted through the fluid guiding member communicatingly connected to the fluid collector.

Another object of the present invention is to provide a banknote processor which can prevent fluid flowing into a banknote insertion port from flowing into interior of a machine in which the banknote processor is mounted.

In accordance with another aspect of the present invention, the above object is attained by a banknote processor for judging whether a banknote inserted into a banknote insertion port is authentic or false, storing the inserted banknote in the interior of a processor body when judging that the banknote is authentic and returning the inserted banknote to the banknote insertion port when judging that the banknote is false, which banknote processor comprises an inclined wall formed as a bottom of the banknote insertion port, inclination of the inclined wall being increased along a banknote insertion direction, the inclined wall being provided therein with a plurality of fluid discharging openings which are made along a width direction of the inclined wall at a predetermined pitch, a fluid collector disposed at a lower side of a bottom of the processor body for collecting fluid dropping from the bottom, and a fluid guiding member communicatingly connected to the fluid collector for guiding the collected fluid to outside of the processor body.

In such a banknote processor, fluid poured into the banknote insertion port is quickly discharged externally of the banknote processor through the fluid discharging openings made in the inclined wall constituting the bottom of the banknote insertion port; whereas fluid invaded into the interior of the processor body is once collected into the fluid collector disposed at the lower side of the bottom of the processor body and thereafter quickly discharged externally of a machine in which the banknote processor is mounted through the fluid guiding member communicatingly connected to the fluid collector.

DESCRIPTION OF THE PREFERRED EMBODIMENTS

A banknote processor in accordance with an embodiment of the present invention will be detailed with reference to FIG. 1.

Figure 1:
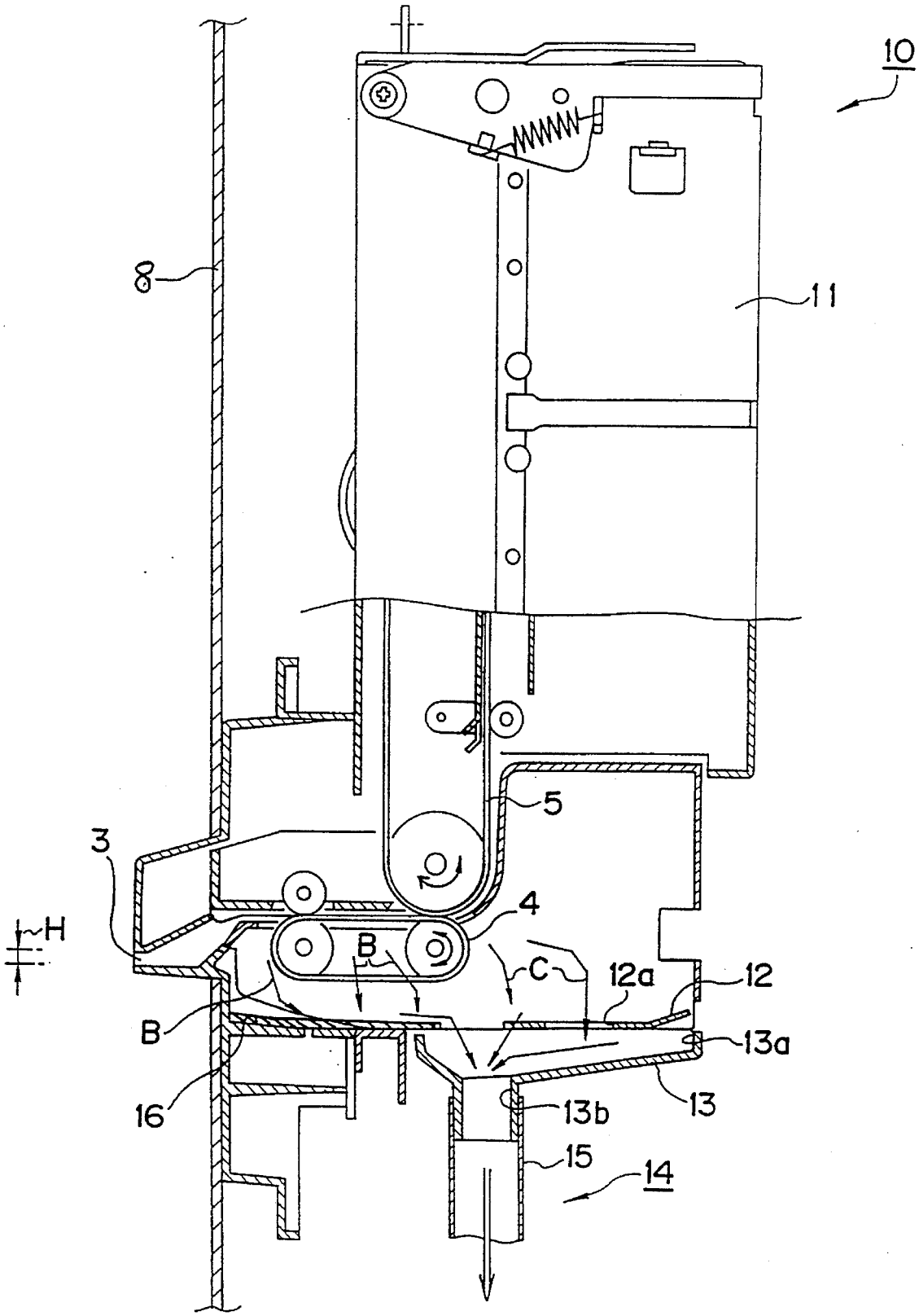
FIG. 1 conceptionally shows, in cross section, a machine to which a banknote processor in accordance with an embodiment of the present invention is mounted.
Figure 9:
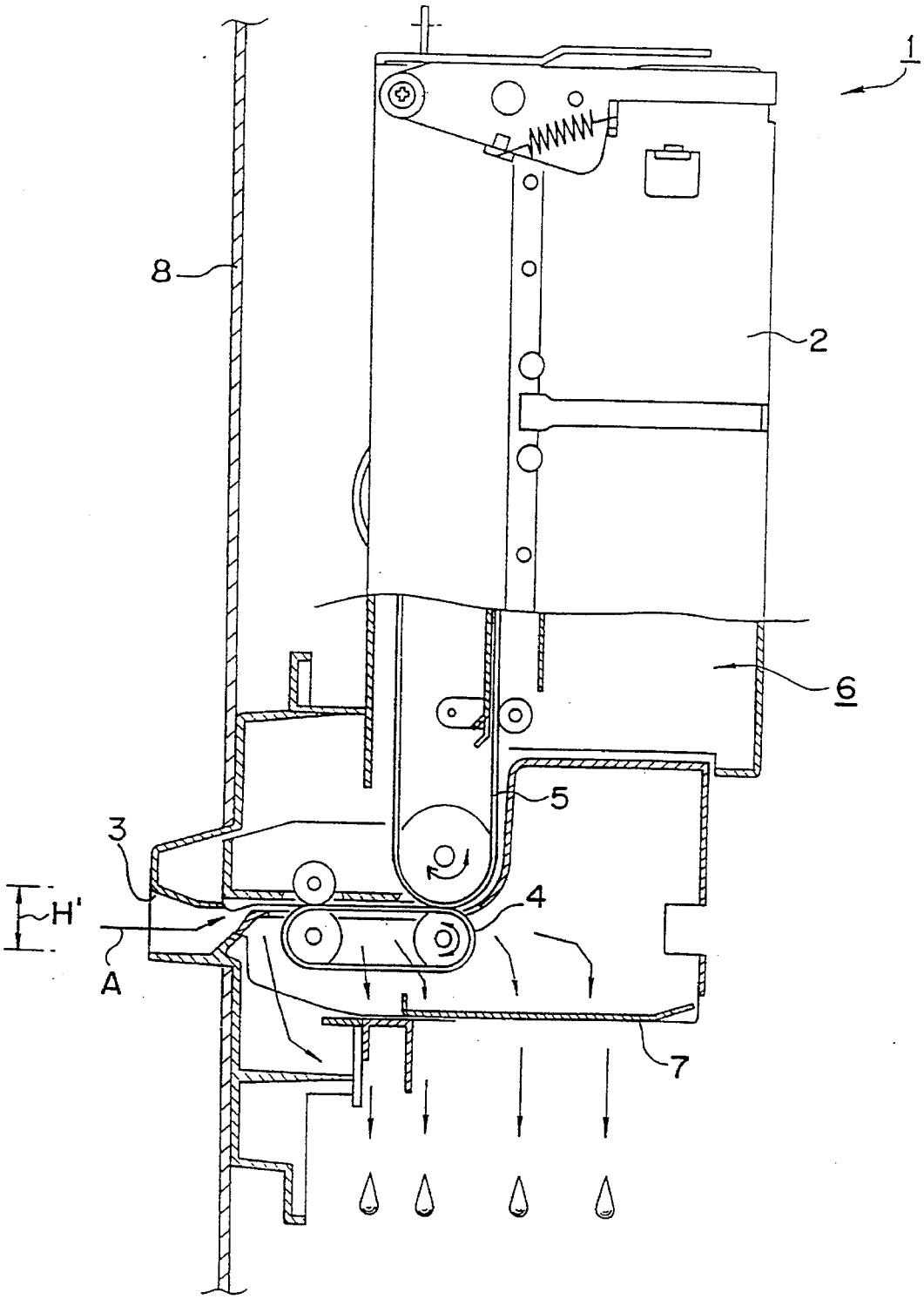
FIG.9 (PRIOR ART)
FIG. 9 conceptionally shows, in cross section, a machine to which a prior art banknote processor is mounted.

FIG. 1 conceptionally shows, in cross section, a banknote processor 10 in accordance with the present invention, in which parts having the same functions as those in FIG. 9 are denoted by the same reference numerals.

In this banknote processor 10, a fluid collector 13 for sealingly covering the whole periphery of a bottom plate 12 is disposed at a lower side of a bottom of a processor body 11, that is, at a lower side of the bottom plate 12 formed as a bottom of the processor body 11.

Figure 2:
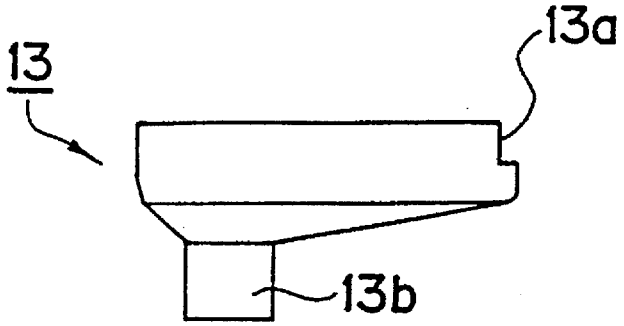
FIG. 2 is a side view of a fluid collector in the banknote processor.
Figure 3:
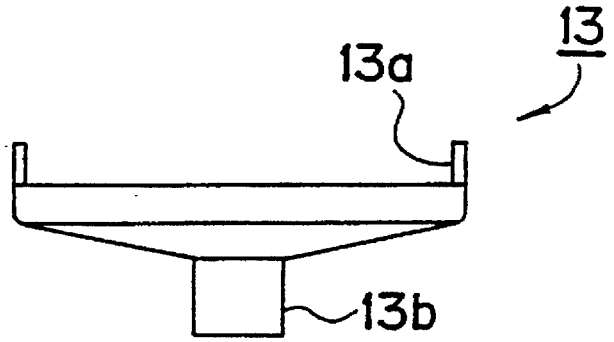
FIG. 3 is a front view of the fluid collector.
Figure 4:
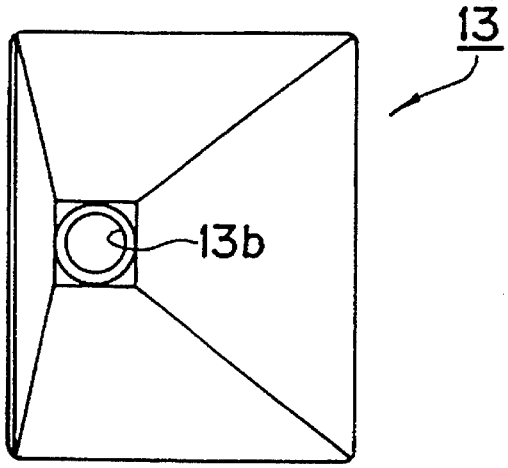
FIG. 4 is a bottom view of the fluid collector.

The fluid collector 13, as shown by a side view in FIG. 2, by a front view in FIG. 3 and by a bottom view in FIG. 4, comprises a member which is nearly rectangular in plan and funneled in cross section. More in detail, the fluid collector 13 is formed in its top part with an opening 13*a* and its lower part with a liquid discharging opening 13*b*.

Connected to the liquid discharging opening 13*b* of the fluid collector 13 is a flexible tube 15 which constitutes a fluid guiding member 14, as shown in FIG. 1. A downstream end of the tube 15 is exposed to the outside of such a machine as an automatic vending machine in which the banknote processor 10 is mounted.

Figure 5:
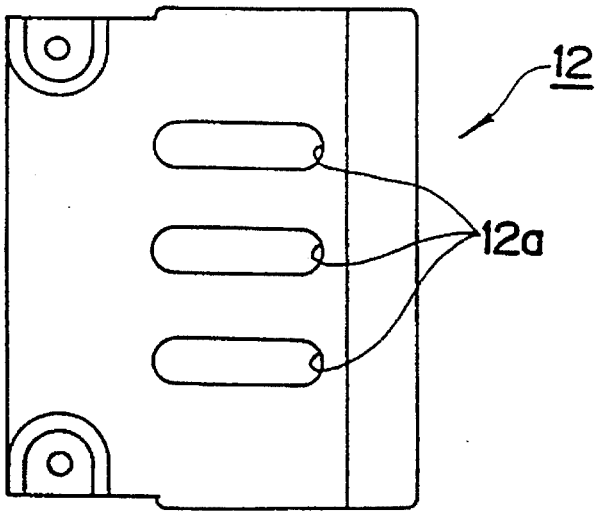
FIG. 5 is a plan view of a bottom plate in the banknote processor.

The bottom plate 12 formed as the bottom of the processor body 11 shown in FIG. 1 is provided therein with such a plurality of holes 12*a* as shown by an enlarged plan view in FIG. 5.

The banknote processor 10 further includes a sheet 16 which, as shown in FIG. 1, constitutes a part of the bottom of the processor body 11 and is disposed adjacent the banknote insertion port 3 and which functions to guide fluid (shown by arrows B) dropped from an immediately downstream part of the banknote insertion port 3 toward the fluid collector 13.

The banknote processor 10 of the present embodiment is arranged so that a height H of the banknote insertion port 3 is smaller than a height H' of the banknote insertion port 3 of the prior art banknote processor 1 of FIG. 9 ($H<H'$), whereby it becomes more difficult for such fluid as rain water to invade from the banknote insertion port 3.

Detailed explanation will next be made as to the operation and structure of the fluid collector 13.

With such a banknote processor 10 as mentioned above, the fluid collector 13 is disposed at the lower side of the bottom plate 12 formed as the bottom of the processor body 11 as shown in FIG. 1. Thus, of such fluid (shown by arrows B and C) as rain water or detergent invaded from the banknote insertion port 3, the fluid (shown by the arrows B) flowing at an immediately downstream position of the banknote insertion port 3 is guided along the sheet 16 and then into the fluid collector 13; whereas, the fluid (shown by the arrows C) reaching to an inner location of inside of the processor body 11, i.e., to a position far from the banknote insertion port 3 is passed through the holes 12*a* of the bottom plate 12 into the fluid collector 13. As a result, the both fluids are once collected into the fluid collector 13.

The fluid collected within the fluid collector 13 is next guided to the flexible tube 15 as a fluid guiding member 14 connected to the fluid collector 13 and also communicating with the fluid discharging opening 13*b*, and then quickly discharged from a downstream end of the tube 15 externally of such a machine as an automatic vending machine having the banknote processor 10 mounted therein.

Meanwhile, when a large amount of fluid is rapidly poured into the banknote insertion port 3, the bottom plate 12 having the holes 12*a* therein functions as a bank for limiting the flow of fluid flowing into the fluid collector 13, which results in that there is no danger that the fluid collected in the fluid collector 13 overflows the collector and runs thereover around.

Although the fluid collector 13 is formed as a part separated from the processor body 11 in the foregoing embodiment, the present invention is not limited to the above embodiment. That is, the fluid collector 13 may be provided integrally with the bottom part of the processor body 11, that is, the fluid collector 13 itself may be formed as the bottom of the processor body 11.

With the aforementioned banknote processor 10, even when such water as rain water or viscous fluid as detergent is made to flow into the banknote insertion port 3, the fluid can be quickly discharged externally of such a machine as an automatic vending machine having the banknote processor mounted therein through the fluid collector 13 disposed at the bottom of the processor body 11 and through the fluid guiding member 14 communicatingly connected to the fluid collector 13. As a result, there can be avoided such a possibility that the fluid flown from the banknote insertion port adheres to various parts such as driving and driven members disposed within such a machine as an automatic vending machine having the banknote processor 10 installed therein and the parts attached with the fluid become faulty. Further, even when such fluid as detergent is wickedly poured into the banknote insertion port, the banknote processor can effectively protect from its wicked action machine in which the banknote processor 10 is mounted and thus can prevent deterioration of the function of the machine caused by the liquid invasion.

A banknote processor in accordance with another embodiment of the present invention will then be detailed.

Figure 6:
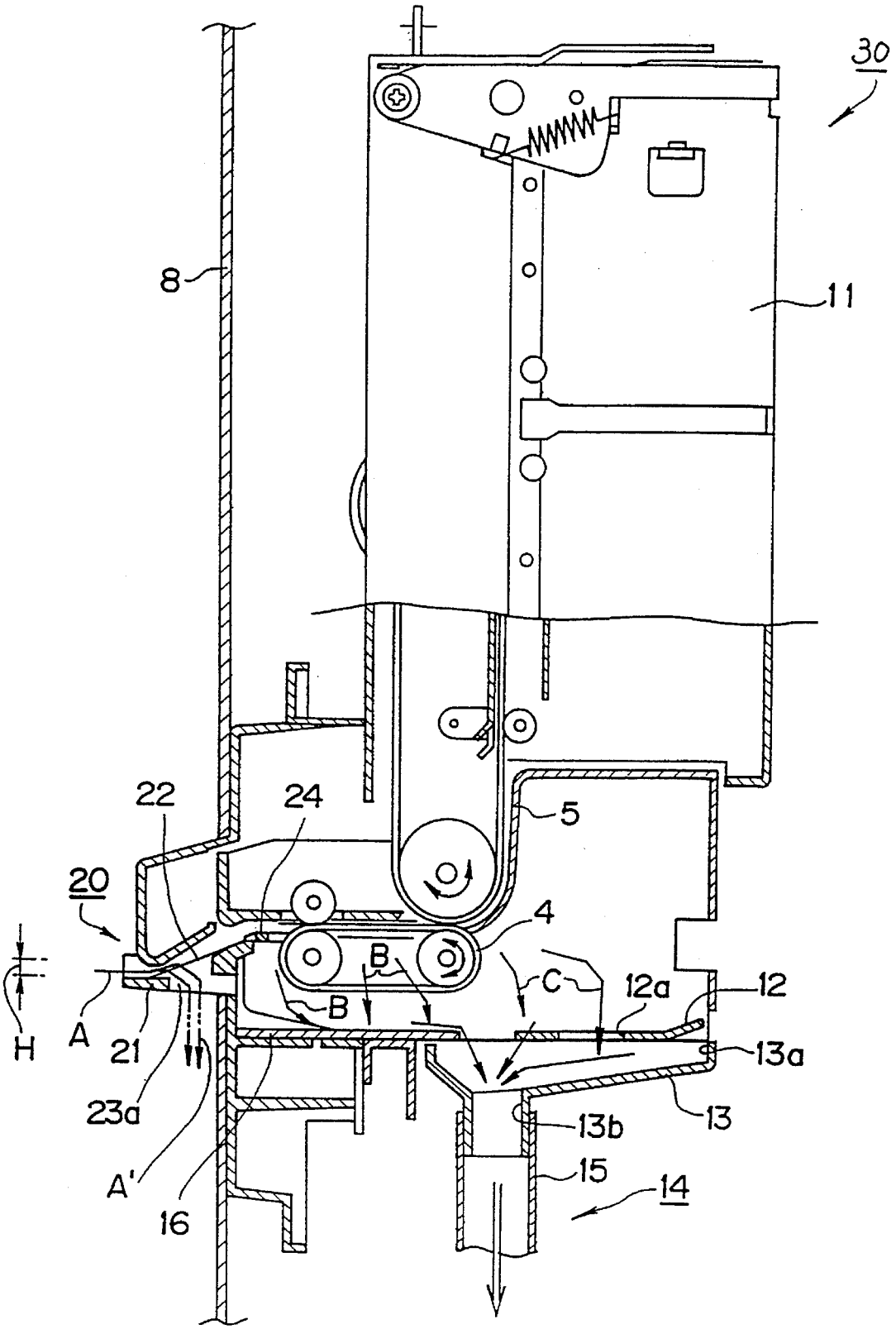
FIG. 6 conceptionally shows, in cross section, a machine to which a banknote processor in accordance with another embodiment of the present invention is mounted.

Conceptionally shown in FIG. 6 is a cross-sectional view of a banknote processor 30 in accordance with another embodiment of the present invention, in which parts having the same functions as those in FIGS. 1 to 5 are denoted by the same reference numerals.

In the banknote processor 30 of the present embodiment, an underplate 21 constitutes a bottom of a banknote insertion port 20 and also constitutes a part of a banknote conveying path. The underplate 21 has an inclined wall 22 which slope is gradually increased along a banknote insertion direction.

Figure 7:
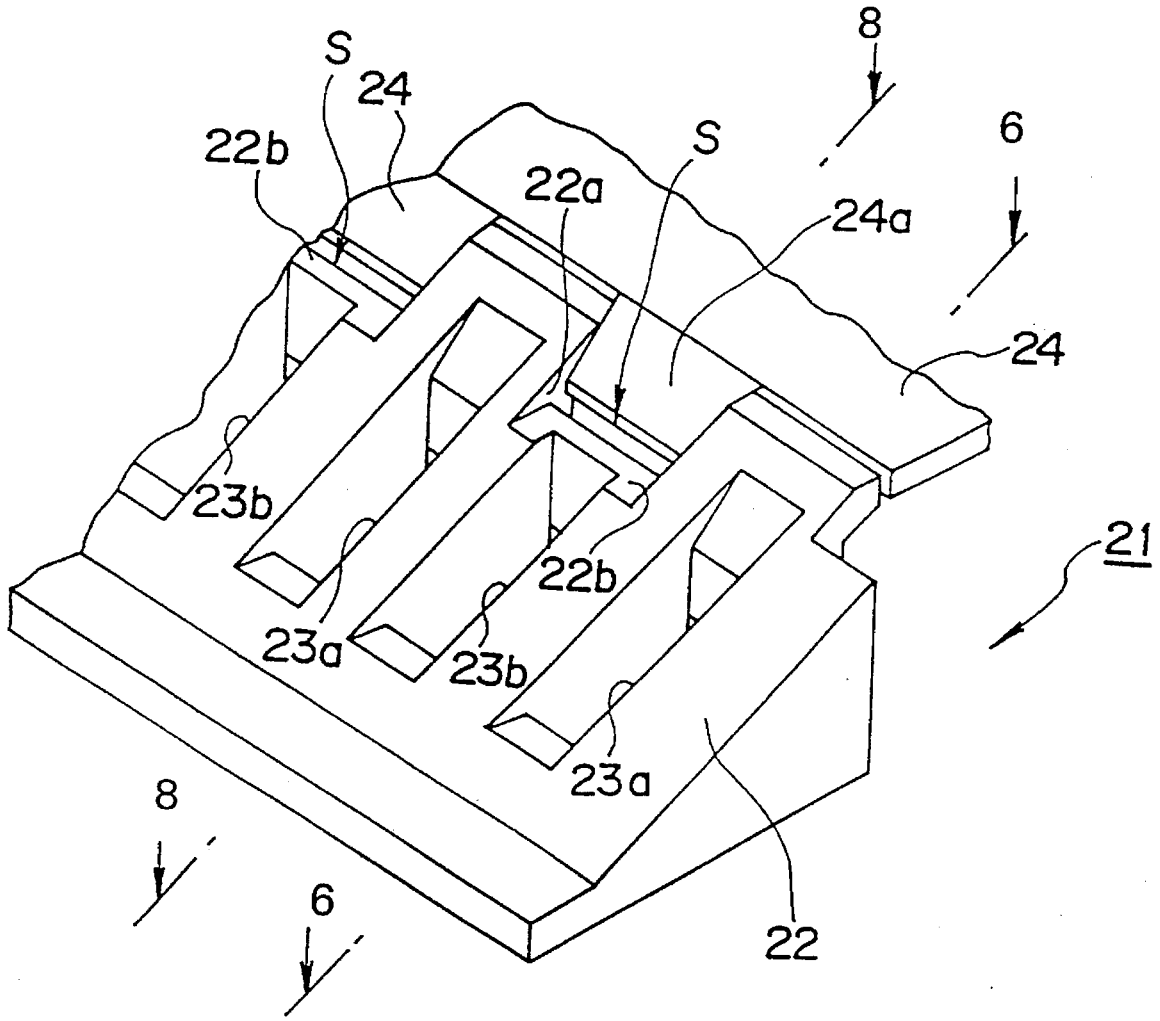
FIG. 7 is a partly broken, enlarged perspective view of an underplate constituting a banknote insertion port in the banknote processor.

The inclined wall 22 of the underplate 21 is provided therein with pluralities of fluid discharging openings 23*a* and 23*b* which are rectangular in plan and which are alternately formed at a predetermined pitch along the width direction of the inclined wall 22 as shown by a major-part enlarged perspective view in FIG. 7. A notch 22*a* is formed at an upper part of each of the fluid discharging openings 23*b* having smaller opening area than that of the opening 23*a*.

A chute, which is followed by the inclined wall 22 and constitutes a part of the banknote conveying path, has a tip end which is formed as a projection 24*a* having a rectangular shape in plan. More specifically, the projection 24*a* of the rectangular shape in plan is bent slightly downwardly and extended into the notch 22*a* formed at the upper part of the fluid discharging opening 23*b*. The projection 24*a*, as illustrated, does not reach a bottom 22*b* of the notch 22*a*, that is, is disposed as opposed to the bottom 22*b* and as spaced therefrom by a predetermined gap S.

Figure 8:
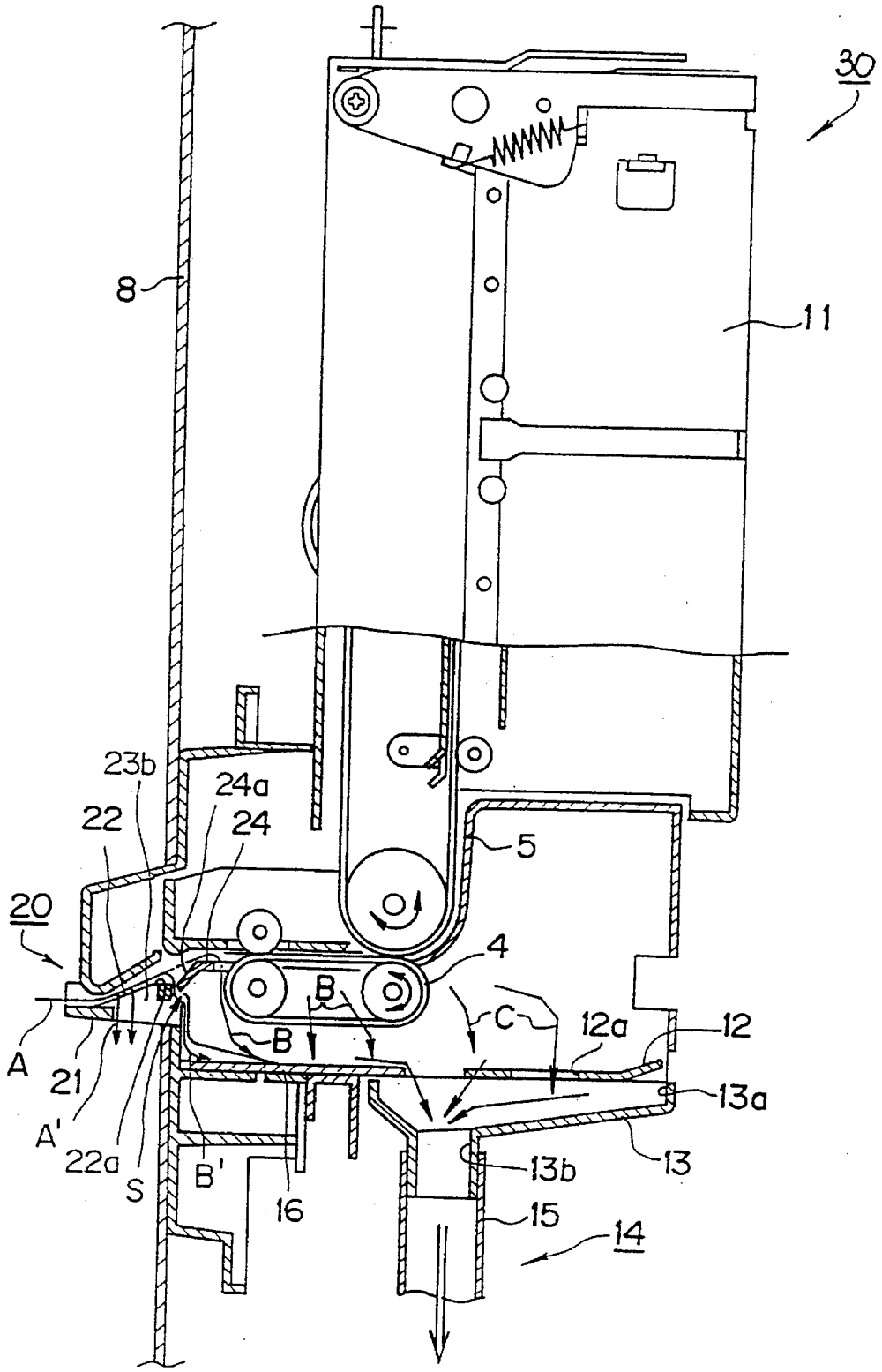
FIG. 8 conceptionally shows, in cross section, a machine to which a banknote processor in accordance with a further embodiment of the present invention is mounted.

A view of the underplate 21 of FIG. 7 taken along line 6—6 corresponds to the cross-sectional view of the banknote insertion port 20 of FIG. 6; while a view of the 21 of FIG. 7 taken along line 8—8 corresponds to a cross-sectional view of the banknote insertion port 20 of FIG. 8.

As shown in FIG. 6, even the banknote processor 30 is arranged so that a height H of the banknote insertion port 20 is set to be smaller than a height H' of the banknote insertion port 3 of the prior art banknote processor 1 of FIG. 9 (H<H') and it becomes difficult for such fluid as rain water to invade into the banknote insertion port 3.

The fluid discharging operation of the aforementioned banknote processor 30 together with its structure will be detailed.

With the aforementioned banknote processor 30, as shown in FIG. 6, liquid (shown by an arrow A) such as rain water or detergent flowing into the banknote insertion port 20 first passes along the inclined wall 22 constituting the bottom of the banknote insertion port 20, drops downwardly (shown by arrows A') of the banknote insertion port 20 through the fluid discharging openings 23*a* and 23*b* (see FIG. 7) of the inclined wall 22, and then is quickly discharged externally of such a machine as an automatic vending machine having the banknote processor 30 installed therein.

Meanwhile, since the fluid collector 13 is provided at the lower side of the bottom plate 12 formed as the bottom of the processor body 11, part of fluid (shown by an arrow B') of the invaded fluid (shown by the arrow A) proceeding over the fluid discharging opening 23*b* of the banknote insertion port 20 advances along the gap S (see FIG. 7) defined between the chute 24 and the notch 22*a* formed at the upper part of the fluid discharging opening 23*b* and also along the sheet 16, and then flows into the fluid collector 13 as shown in FIG. 8.

Fluid (shown by arrows B) invaded into the interior of the processor body also flows into the fluid collector 13. Fluid (shown by arrows C) reaching to an inner location of inside of the processor body 11, i.e., to a position far from the banknote insertion port 20 also flows through the holes 12*a* of the bottom plate 12 into the fluid collector 13. As a result, the respective fluids are once collected into the fluid collector 13.

The fluid collected within the fluid collector 13 is next guided to the flexible tube 15 as a fluid guiding member 14 connected to the fluid collector 13 and also communicating with the fluid discharging opening 13*b*, and then quickly discharged from a downstream end of the tube 15 externally of such a machine as an automatic vending machine having the banknote processor 30 mounted therein.

Meanwhile, even when a large amount of fluid is rapidly poured into the processor body 11, the bottom plate 12 having the aforementioned holes 12*a* therein functions as a bank for limiting the flow of fluid flowing into the fluid collector 13, which results in that there is no danger that the fluid collected in the fluid collector 13 overflows the collector and runs thereover around.

Although the fluid collector 13 is formed as a part separated from the processor body 11 in the foregoing embodiment, the present invention is not limited to the above embodiment. For example, the funnel-shaped fluid collector 13 may be provided integrally with the bottom part of the processor body 11, that is, the fluid collector 13 itself may be formed as the bottom of the processor body 11.

As has been explained in the foregoing, in accordance with the aforementioned banknote processor 30, even when such water as rain water or viscous fluid as detergent is made to flow into the banknote insertion port 20, the fluid can be quickly discharged externally of such a machine as an automatic vending machine having the banknote processor 30 mounted therein through the fluid discharging openings 23*a* and 23*b* made in the inclined wall 22 constituting the bottom of the banknote insertion port 20. Further, the fluid reaching the interior of the banknote processor 30 can also be quickly discharged externally of such a machine as an automatic vending machine having the banknote processor 30 mounted therein through the fluid collector 13 disposed at the bottom of the processor body 11 and through the fluid guiding member 14 communicatingly connected to the fluid collector 13. As a result, there can be avoided such a possibility that the fluid invaded from the banknote insertion port 20 adheres to various parts such as driving and driven members disposed within such a machine as an automatic vending machine having the banknote processor 30 installed therein and that the parts attached with the fluid become faulty. Further, even when such fluid as detergent is wickedly poured into the banknote insertion port, the banknote processor can effectively protect from its wicked action a machine in which the banknote processor 30 is mounted and thus can prevent and minimize deterioration of the function of the machine caused by the liquid invasion. Furthermore, since the bottom wall of the banknote insertion port 20 is made simply as an inclined wall 22, the insertability of banknotes into the banknote insertion port 20 is not impaired.

The present invention can be modified in various ways without departing from the spirit or major feature of the invention. Thus, the foregoing embodiments should be interpreted as given merely as examples in all points and should not be interpreted as limited. The scope of the present invention is defined by the appended claims and should not be restricted by the body of the specification. In addition, all modifications and changes within the equivalent scope of the claims should be understood to be included in the scope of the claims.

What is claimed is:

1. A banknote processor for judging whether a banknote inserted into a banknote insertion port is authentic or false, storing the inserted banknote in an interior of a processor body when judging that the inserted banknote is authentic and returning the inserted banknote to the banknote insertion port when judging that the inserted banknote is false, the banknote processor comprising:

an underplate mounted on the processor body for forming a bottom face of the banknote insertion port;

an inclined wall formed as an upper face of the underplate such as to gradually ascend along a banknote insertion direction;

a plurality of first fluid discharge openings and a second fluid discharge opening having opening areas smaller than those of the first fluid discharge openings, the first and second fluid discharge openings formed on a midpoint of the ascending inclined wall disposed adjacent to each other in a width direction of the inclined wall;

a notch formed at a top end portion of the underplate above the second fluid discharge opening and having a rectangular shape in plan;

a chute provided following a top end of the inclined wall and constituting a part of a banknote conveying path along which a banknote inserted into the banknote insertion port is conveyed;

a projection provided at the chute opposed to the notch of the underplate and bending downward, the projection having a rectangular shape in plan;

a gap serving as a fluid discharge opening, defined by a bottom of the notch and the projection when the positioning of the underplate relative to the chute is performed by inserting the projection into the notch;

fluid collector means provided below the processor body having a funnel shape with a top part thereof being an opening for collecting liquid and a lower part thereof being a liquid discharge opening for discharging collected liquid; and fluid guiding means connected to the liquid discharge opening of the fluid collector means, for guiding the collected liquid outside of the processor body.

2. A banknote processor as set forth in claim 1, wherein the inclined wall has notches for guiding fluid at upper portions of the plurality of fluid discharging openings.

3. A banknote processor as set forth in claim 1, wherein the fluid collector means comprises a funnel-shaped member being provided in its upper part with an opening for collecting fluid, the member being provided in its lower part with a discharging opening for discharging the collected fluid.

4. A banknote processor as set forth in claim 1, wherein the fluid guiding means comprises a flexible tube connected to the discharging opening.

5. A banknote processor as set forth in claim 1, wherein the processor body comprises a bottom plate provided separately from the processor body.

6. A banknote processor as set forth in claim 5, wherein the bottom plate is provided therein with a plurality of holes.

* * * * *